United States Patent [19]

Yankoff

[11] Patent Number: 4,830,280

[45] Date of Patent: May 16, 1989

[54] NOZZLE

[76] Inventor: Gerald K. Yankoff, 5370 Tall Tree Way, West Chester, Ohio 45069

[21] Appl. No.: 170,560

[22] Filed: Mar. 21, 1988

[51] Int. Cl.[4] ..... B05B 17/04

[52] U.S. Cl. ..... 239/11; 239/590; 239/591

[58] Field of Search ..... 239/11, 589, 590, 590.3, 239/590.5, 591, 461, 463

[56] References Cited

U.S. PATENT DOCUMENTS

| | | | |
|---|---|---|---|
| 1,656,160 | 1/1928 | Badaracco | 239/590.3 |
| 4,545,317 | 10/1985 | Richter et al. | 239/589 |
| 4,718,178 | 1/1988 | Whipple | 239/590 |

*Primary Examiner*—Andres Kashnikow
*Assistant Examiner*—Karen B. Merritt
*Attorney, Agent, or Firm*—Wood, Herron & Evans

[57] ABSTRACT

A nozzle for discharging flowable material comprises a nozzle body formed with an inlet passageway adapted to connect to a source of flowable material and a smaller diameter outlet passageway which is coaxial with and intersects the inlet passageway forming a shoulder therebetween. An annular recess is formed in the shoulder concentric to the outlet passageway. A tubular-shaped insert carried within the outlet passageway extends at least partially into the inlet passageway, and is formed with a throughbore having an angled inlet end within the inlet passageway of the nozzle body and a discharge end within the outlet passageway. A portion of the flowable material from a stream transmitted into the inlet passageway enters the recess and is rotated in the direction of flow of the material through the nozzle. This rotating portion of the stream within the recess tangentially impacts the main body of the stream at a point tangent thereto whereby the stream is guided and accelerated into the inlet end of the throughbore in the insert and discharged from the nozzle at increased velocity with minimal drag losses.

17 Claims, 2 Drawing Sheets

NOZZLE

FIELD OF THE INVENTION

This invention is directed to nozzles, and, more particularly, to a nozzle for discharging flowable materials which operates at high efficiency with minimal losses.

BACKGROUND OF THE INVENTION

Nozzles are employed in a wide variety of applications to direct flowable materials such as particulate solids, liquids or gases in a desired flow path. In many applications, nozzles function to accelerate the flowable material supplied from a source at constant pressure and flow rate. Typically, the flowable material is pumped from the source through a supply line which is connected to a nozzle having a discharge passageway of smaller diameter than the supply line so that at constant pressure and flow rate the velocity of the flowable material ejected from the discharge orifice of the nozzle is much greater than its velocity through the supply line.

In nozzles of the type described above, a "transition area" is formed between the supply line and discharge orifice of the nozzle in which the diameter or cross sectional area of the flow path of the flowable material decreases For example, one type of "transition area" employed in the prior art resembles a venturi tube in which the flow path of the flowable material uniformly tapers in a radially inward direction from the larger diameter supply line to the much smaller diameter discharge orifice in the nozzle. This uniform taper in the transition area of the flow path between the supply line and nozzle discharge orifice is intended to create laminar flow of the flowable material as it moves into the nozzle so as to reduce turbulence and drag losses and thus improve the nozzle "efficiency". The term "efficiency" as used herein refers to the actual velocity or flow rate of the flowable material ejected from the discharge orifice of a nozzle as a percentage of the ideal, i.e., theoretical velocity or flow rate, which would be obtained if there were no losses due to drag or turbulence.

Although it has been found that nozzle efficiency can be increased by providing a smoothly tapering transition area, the efficiency of such nozzles is not optimum. Eddies and other turbulent flow of the flowable material are created along the walls of the tapered transition area which disrupts the flow pattern of the flowable material. Depending upon the viscosity of the flowable material, such turbulence creates drag and reduces the actual velocity or flow rate of the flowable material through the nozzle as compared to its theoretical velocity. In applications where the velocity or flow rate of the flowable material discharged from the nozzle is critical, such losses in the transition area leading to the discharge orifice of the nozzle may require the use of a larger pump, and/or an increased flow rate, in order to obtain the desired discharge velocity.

SUMMARY OF THE INVENTION

It is therefore among the objectives of this invention to provide a nozzle for discharging flowable material which minimizes drag losses and discharges the flowable material with high efficiency, i.e., with an actual velocity which closely approaches the theoretical velocity at constant pressure and flow rate These objectives are accomplished in a nozzle for discharging flowable material which comprises a nozzle body having an inlet passageway adapted to connect to a supply line from a source of flowable material, and an outlet passageway having a smaller diameter than the inlet passageway which is coaxial with and intersects the inlet passageway. An annular, donut-shaped recess is formed at the intersection of the inlet and outlet passageways concentric to a hollow, tubular-shaped wall section which is carried within the outlet passageway and extends outwardly therefrom at least partially into the inlet passageway. The tubular wall section is formed with a throughbore defining an inner surface having an axially extending, arcuate-shaped portion beginning at an angled throat or inlet end of the throughbore, and a cylindrical-shaped portion.

An important aspect of this invention is predicated upon the discovery that a portion of the stream of flowable material, which flows into the inlet passageway of the nozzle is made to enter the donut-shaped recess concentric to the tubular wall section protruding into the inlet passageway. This portion of the stream of flowable material, e.g., a water stream, is rotated within the recess in the same direction as the flow of the water stream through the nozzle. As the main body of the water stream flows through the transitional area between the larger diameter inlet passageway and the smaller diameter outlet passageway, the rotating portion of the water stream within the recess impacts the outer boundary of the water stream and functions to guide, reduce drag and assist in accelerating the main body of the water stream into the angled throat or inlet end of the throughbore in the wall section which protrudes into the inlet passageway.

The rotating portion of the fluid stream within the recess, and the angled throat portion and arcuate inner surface of the throughbore in the wall section, combine to eliminate much of the turbulence produced in prior art nozzles where a fluid stream flows between passageways of decreasing diameter. It is believed that the rotating portion of the fluid stream within the recess herein substantially reduces the formation of eddies and other turbulent flow patterns in the transition area between the inlet and outlet passageways. In addition, the angled inlet or throat portion of the throughbore in the protruding wall section of the nozzle closely approximates the velocity profile of the water stream within the inlet passageway, immediately upstream from the outlet passageway. The water stream thus tends to "mate" with or match the shape of the throat of the throughbore in the wall section which further reduces the turbulence and resulting drag losses. In addition, the water stream smoothly flows along the arcuate-shaped inner surface formed in the throughbore of the wall section to further reduce turbulence thereat.

In one presently preferred embodiment of this invention, an insert is carried within the outlet passageway of the nozzle body. The insert is tubular in shape having a cylindrical outer surface and an inner surface defining a throughbore having an inlet end or throat and a discharge end. The insert is mounted within the outlet passageway so that at least a portion of the insert extends within the inlet passageway in the nozzle body. In this position, the inlet end or throat of the throughbore in the insert is spaced from the recess formed in the nozzle body.

The inner surface of the wall of the insert is preferably formed in two portions. One portion is formed in an arcuate shape which extends from the angled throat or inlet end of the throughbore axially toward its discharge end. The other section of the throughbore in the insert is cylindrical in shape having a uniform diameter. This cylindrical section extends from the first, arcuate-shaped portion of the throughbore to its discharge end.

In an alternative embodiment, it is contemplated that the nozzle body could be machined to form structure equivalent to the insert described above. In this embodiment, the outlet passageway in the nozzle body is formed with a diameter equal to the uniform diameter portion of the throughbore in the insert described above. An annular recess is machined in the nozzle body at the intersection of the inlet and outlet passageways which is concentric to, but spaced from, the inner surface of the outlet passageway so that a wall section is formed therebetween which protrudes into the inlet passageway of the nozzle body. The inner surface of this wall section or protrusion is then formed with an angled throat or inlet end and a generally arcuate surface which extends axially along a portion of the inner surface of the wall. The remaining cylindrical-shaped portion of the outlet passageway is retained. This embodiment of the nozzle herein functions in the same manner as the nozzle with a separate insert, described above.

As discussed in detail below, there are a number of design considerations involved in the formation of the insert or protrusion, and the recess, which are dependent on the flow rate and pressure of the flowable material pumped from the source, the desired discharge velocity of the flowable material from the nozzle and the characteristics of the flow able material such as its viscosity and the like. Calculations and/or measurements can be made, as described below, to approximate diameters of the inlet and outlet passageways, the angle of the throat or inlet end of the insert or protrusion, the axial length of the arcuate portion of the inner surface of the insert wall and the radial dimension and depth of the annular recess.

DESCRIPTION OF THE DRAWINGS

The structure, operation and advantages of the presently preferred embodiment of this invention will become further apparent upon consideration of the following description taken in conjunction with the accompanying drawings, wherein.

DETAILED DESCRIPTION OF THE INVENTION

Figure 1:
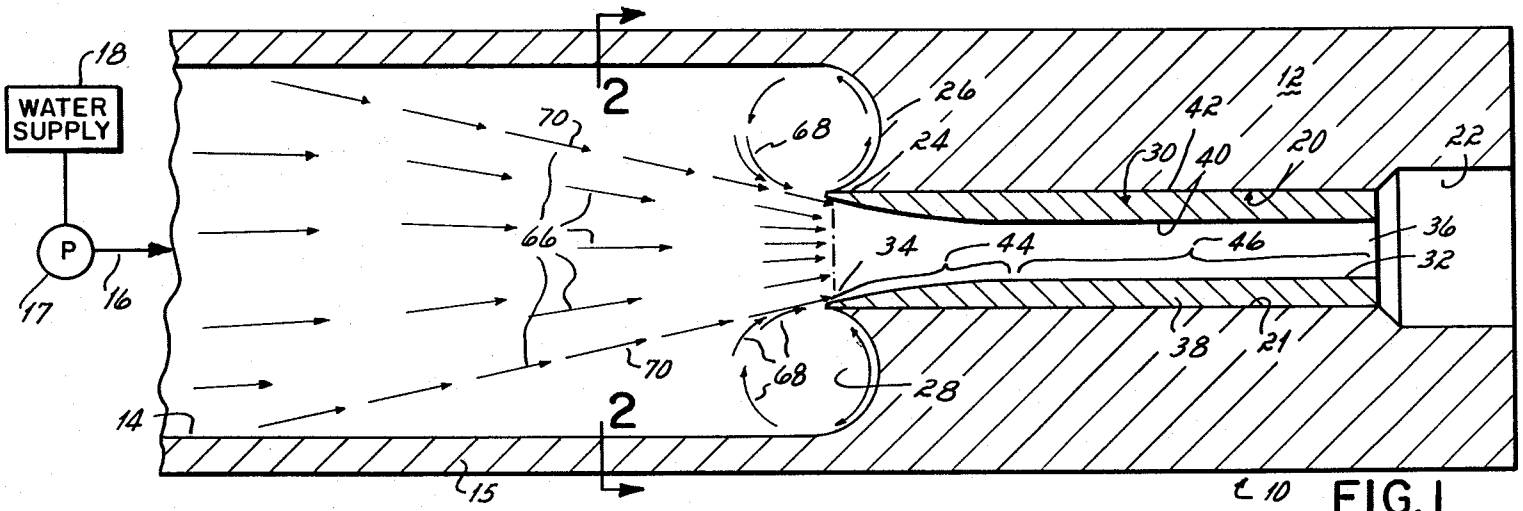
FIG. 1 is an enlarged cross sectional view of one embodiment of the nozzle of this invention.

Referring now to FIG. 1, the nozzle 10 of this invention comprises a nozzle body 12 formed with an inlet passageway 14 connected by a fitting (not shown) to a delivery line 16. The delivery line 16, in turn, is connected to a pump 17 or other means of transmitting flowable material from a source 18. For purposes of the present discussion, it is assumed that the flowable material is a liquid stream such as water although it is contemplated that other flowable materials could be discharged from the nozzle 10 herein including particulate material such as sand or powder, or gaseous materials.

The nozzle body 12 is also formed with an outlet passageway 20 which is coaxial with the inlet passageway 14. The outlet passageway 20 has a stepped discharge end 22 and an inlet end 24 of smaller diameter. The outlet passageway 20 has a smaller diameter than that of the inlet passageway 14 and intersects the inlet passageway 14 forming a shoulder 26 therebetween.

Figure 2:
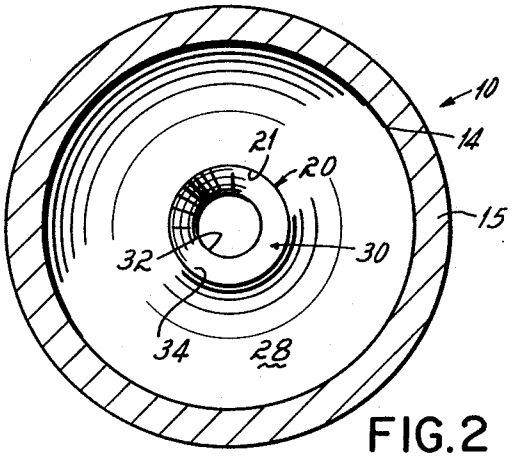
FIG. 2 is a cross sectional view taken generally along line 2—2 of FIG. 1.

As shown in FIGS. 1 and 2, the nozzle body 12 is formed with an annular recess 28 at the shoulder 26 formed by the intersection of the inlet and outlet passageways 14, 20. In the embodiment of FIGS. 1 and 2, the recess 28 terminates at the inner surface 21 of outlet passageway 20 and is concentric thereto. Preferably, the recess 28 is formed with a generally U-shaped cross section, although it is contemplated that other cross sections could be employed for the purposes described below.

Figure 4:
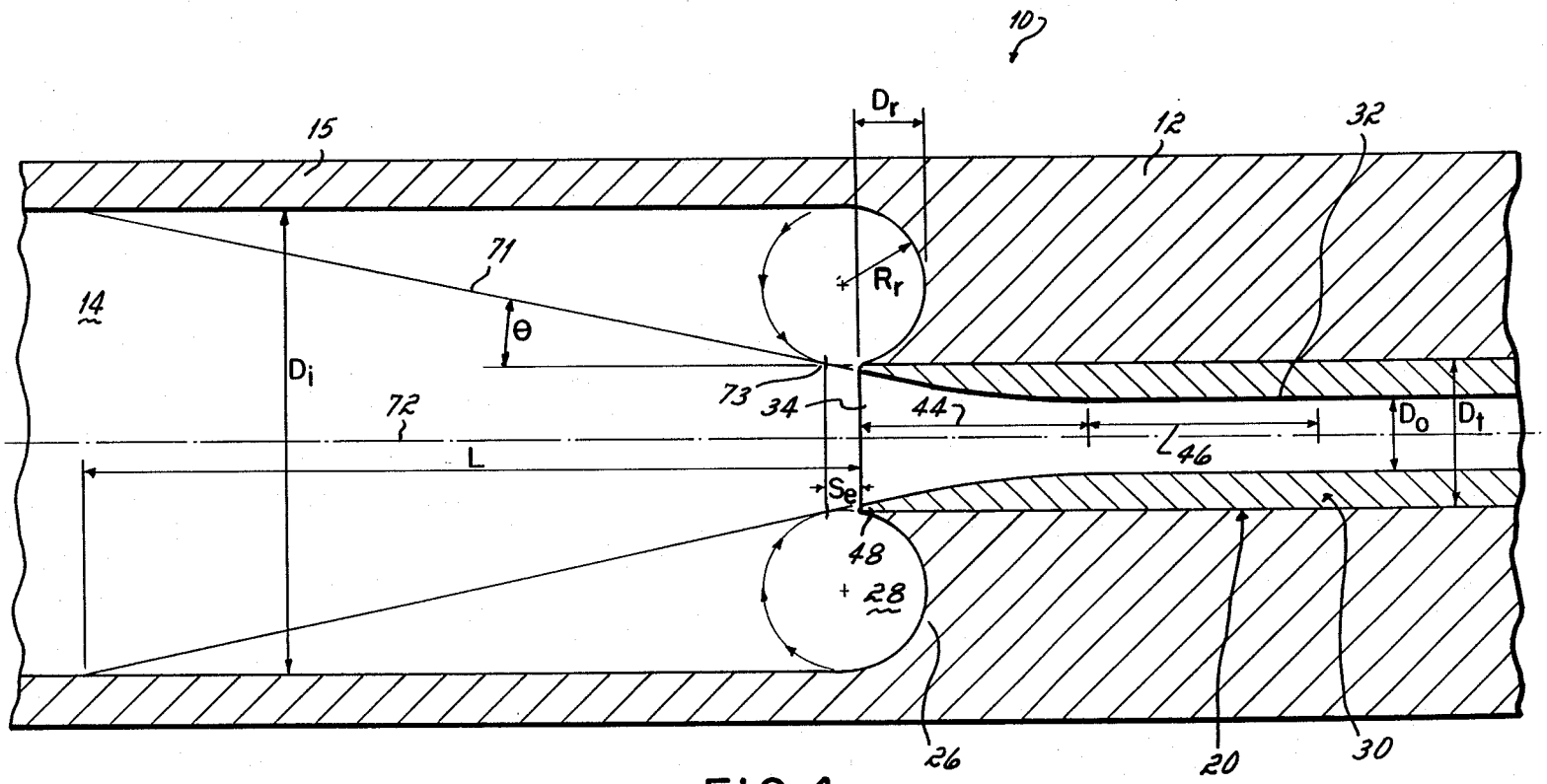
FIG. 4 is a cross sectional view similar to FIG. 1 illustrating the dimensions employed in the design calculations of the nozzle herein.

In the embodiment of FIGS. 1, 2 and 4, a hollow, tubular-shaped insert 30 is mounted within the interior of the outlet passageway 20 and extends at least partially into the inlet passageway 14. The insert 30 is formed with a throughbore 32 having an angled throat or inlet end 34 extending within the inlet passageway 14 spaced from the recess 28, and an outlet end 36. The wall 38 of the insert 30 formed by the throughbore 32 has an inner surface 40 and a cylindrical-shaped, outer surface 42 which contacts the inner surface 21 of the outlet passageway 20.

In the presently preferred embodiment, the inner surface 40 of insert 30 is formed in two sections which extend axially along the length of the insert 30. One section of the inner surface 40 of insert 30 is arcuate in shape and this arcuate section 44 extends from the throat or inlet end 34 of the throughbore 32 axially toward the outlet end 36 of the throughbore 32. That is, the shape of the inner surface 40 of the insert wall 38 within the arcuate section 44 is curved or tapered in an axial direction beginning at the inlet end 34 of throughbore 32. The remainder of the axial length of the inner surface 4 of insert 30 is cylindrical in shape and has a uniform diameter. This cylindrical section 46 extends axially from the arcuate section 44 to the outlet end 36 of the throughbore 32.

Figure 3:
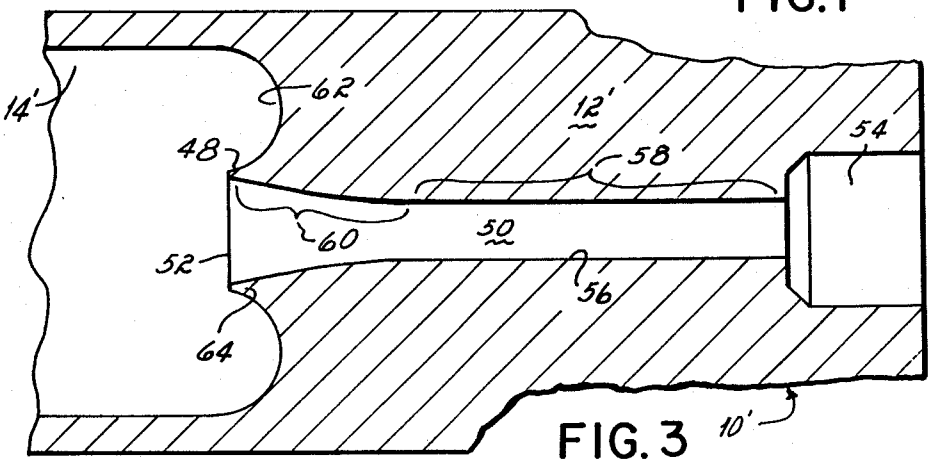
FIG. 3 is a view similar to FIG. 1 of an alternative embodiment of the nozzle herein.

Referring now to FIG. 3, an alternative embodiment of the nozzle 10' is illustrated in which the insert 30 is eliminated. In this embodiment, the nozzle body 12' is formed with an inlet passageway 14' and an outlet passageway 50 having an inlet end 52, a stepped outlet end 54 of larger diameter and an inner surface 56. The inner surface 56 formed by the outlet passageway 50 has an arcuate section 60 extending axially from the inlet end 52 of outlet passageway 50 which is identical to the arcuate section 44 of insert 30, and a cylindrical section 58 extending axially from the arcuate section 60 which is identical to the cylindrical section 46 of insert 30. A protrusion 48 is formed by machining a recess 62 in the nozzle body 12' at the intersection of the inlet and outlet passageways 14', 50. The recess 62 is concentric to but spaced from the outlet passageway 50 in the nozzle body 12' forming the wall of the protrusion 48.

The axial dimensions of the sections 58, 60 of the inner surface 56 of outlet passageway 50, the radial dimension of recess 62 and the axial space between recess 62 and the inlet end 52 of outlet passageway 50 are all identical to the corresponding structure of the nozzle 10 shown in FIGS. 1 and 2. These dimensions, and a procedure for calculating such dimensions in a particular application, are described in detail below with reference to FIG. 4.

The operation of nozzle 10 shown in FIGS. 1 and 2 is believed to be as follows, and nozzle 10' operates in the identical manner. A fluid stream 66 is pumped into the inlet passageway 14 of the nozzle 10 through the delivery line 16 from the source 18. A portion 68 of this fluid stream 66 flows into the annular, U-shaped recess 28 which is concentric to the insert 30. It is believed that the fluid portion 68 entering the recess 28 is made to rotate in the direction of the arrows as viewed in FIG. 1, so that such fluid portion 68 impacts the outermost layer 70 of the fluid stream 66 while moving in the same direction as the flow of the fluid stream 66 through the nozzle 10. This body or portion 68 of rotating fluid within the recess 28 functions to reduce drag, guide and assist in accelerating the main body of the fluid stream 60 into the throat or angled inlet end 34 of the throughbore 32 in FIGS. 1 and 2.

As described more fully below, the throat or inlet end 34 of the throughbore 32 in insert 30 is formed at an angle which is designed to approximate the velocity profile of the fluid stream 66 as it moves from the inlet passageway 14 into the nozzle 30. In addition, the arcuate-shaped section 44 of the wall of throughbore 32 is smoothly tapered between the inlet end 34 and a point downstream where the cylindrical section 46 of throughbore 32 begins. The shape of the arcuate section 44 further lessens the turbulence in the fluid stream 66 as it flows from larger to smaller diameter and helps smoothly guide and accelerate the fluid stream 66 from the inlet passageway 14 into the smaller diameter throughbore 32 of the insert 30.

It is believed that the rotating body or portion 68 of fluid within the recess 28, the angle throat or inlet end 34 of insert 30 and the arcuate shape of the inlet area of throughbore 32 of insert 30 all combine to maximize the efficiency of the nozzle 10. The fluid stream 66 is relatively smoothly directed from the larger diameter inlet passageway 14 into the smaller diameter throughbore 32 with minimal losses in the transition from larger to smaller diameter. As a result, the actual velocity or flow rate of the fluid stream 66 discharged from the nozzle 10 or 10' more closely approximates the ideal velocity or flow rate which should be obtained if no losses were present.

Nozzle Design

Referring now to FIG. 4, it has been discovered that several design parameters are involved in optimizing the efficiency of nozzle 10 for a given application. The following discussion provides a procedure for determining these design parameters where the flow rate of the fluid stream and the desired discharge velocity from the nozzle 10 are known. For purposes of the present discussion, it is assumed that the fluid stream 66 is water although other flowable material can be discharged from the nozzle 10.

Assume that a given application requires the supply of a stream of water at the following flow rate and discharge velocity from the nozzle 10:

$Q = 6$ gallons per minute (gpm)

$V_D = 900$–$945$ feet per second (fps)

Where:

$Q$ = flow rate $V_D$ = desired discharge velocity of the fluid stream.

Pump Selection

In order to obtain the desired flow rate and discharge velocity, assuming ideal (no loss) flow conditions, a pump 17 must be selected having a 6 gpm flow rating and a pressure rating which can deliver the water stream at the required velocity for that flow rate. From Bernoulli's equation, velocity can be expressed in direct relation to pressure with the following relationship:

$$V = \sqrt{12.2\ P} \tag{1}$$

Where:

$V$ = liquid velocity (fps)

$P$ = liquid pressure (psi)

Substituting the discharge velocity, $V_D$, of 945 fps into the equation yields:

$P = 6{,}000$ pounds.

The pump 17 should therefore have a pressure rating of 6,000 pounds and a flow rating of 6 gpm.

Inlet Diameter, $D_i$

It is generally agreed that laminar flow conditions are obtained in a pipe or other cylindrical conduit at a velocity of about 30 feet per second (fps) or less. For purposes of the present discussion, it is assumed that a flow rate of about 25 fps is desired upstream from the insert 30 within the inlet passageway 14 to ensure laminar flow. Knowing the flow rate through delivery line 16, the cross sectional area and diameter of the inlet passageway 14 in nozzle body 12 can be readily calculated to obtain a velocity of 25 fps therethrough using the following equation:

$$Q = kV_iA \tag{2}$$

$$Q = kV_i\left[\pi\left(\frac{D_i}{2}\right)^2\right] \tag{3}$$

Where:

$Q$ = flow rate-(6 gpm)

$V_i$ = velocity desired in the inlet passageway (14–25 fps)

$D_i$ = diameter of inlet passageway 14.

$k$ = viscosity coefficient (for water, $k = 1$)

Solving for $D_i$ in the above equations yields:

$D_i = 0.313$ inches.

Outlet Diameter, $D_o$

Assuming ideal conditions, i.e., that no losses are created as the stream of water flows through nozzle 10, the cross sectional area and diameter "$D_o$" of the discharge orifice of the nozzle 10, or the outlet end 36 of the insert throughbore 32, can also be readily calculated given a constant flow rate and a desired discharge velocity. Using the sam flow rate formula given above, $D_o$ appears in such equation as follows:

$$Q = kV_oA \tag{4}$$

-continued $$Q = kV_o\left[\pi\left(\frac{D_o}{2}\right)^2\right] \quad (5)$$

Where:

Q=flow rate-(6 gpm)

$V_o$=discharge velocity-(945 fps)

$D_o$=diameter of the outlet end 36 of the throughbore 32 in insert 30.

k=viscosity coefficient (for water, k=1)

Solving for $D_o$ yields:

$D_o$=0.051 inch.

Throat Diameter, $D_t$

Depending upon the type of material to be discharged from the nozzle 10, the wall thickness of the insert 30 is chosen to provide sufficient rigidity and wear life. This wall thickness is represented in FIG. 4 as one-half of the difference between the diameter of the outlet end 36 of throughbore 32, $D_o$, and the diameter of the throat or inlet end 34 of the throughbore 32, $D_t$. Given that a water stream is being discharged from nozzle 10, the thickness of the wall 38 of insert 30 is chosen to be about equal to one-half of the outlet diameter $D_o$ and therefore the throat diameter $D_t$ is given as:

$$D_t = 2\,D_o \quad (6)$$

$D_t$=0.102 inch

Throat Angle, $\theta$

The next aspect of designing the nozzle 10 is to determine the angle of the throat or inlet end 34 of the insert throughbore 32, e.g., the angle $\theta$ between a line 71 tangent to the outermost edge or throat portion of the inner surface 40 of the insert 30 at the inlet end 34 of throughbore 32, and the wall 15 of the inlet passageway 14. It has been found that for a stream of water this tangent line 71 should preferably intersect the wall 15 of inlet passageway 14 at a distance L of about 1.66 times the diameter $D_i$ of the inlet passageway 14, measured parallel to the longitudinal axis 72 of the inlet passageway 14. In other words, the axial distance L between the inlet end 32 of insert 30 and the intersection of tangent line 70 and the wall 15 of inlet passageway 14 is preferably at least about 1.66 $D_i$.

In equation form:

$$L = 1.66\,D_i \quad (7)$$

L=0.512 inch.

The area of inlet passageway 14 along the axial distance L forms a transitional area between the larger diameter inlet passageway 14 and the smaller diameter throughbore 32 of insert 30 where the water stream is accelerated. A transitional area of at least about this length L has been found to effectively reduce upstream turbulence and drag losses within the inlet passageway 14 to obtain improved efficiency. It should be understood that the distance L may vary depending upon the viscosity of a particular material and must be determined empirically by experimentation. Generally, the distance L lengthens when materials having a higher viscosity than water flow through nozzle 10 and the distance L shortens if materials having a lower viscosity than water are employed.

From the above, the angle $\theta$ can be readily calculated. Having determined the diameter $D_i$ of inlet passageway 14 and the diameter $D_t$ of the throat or inlet end 34 of throughbore 32, the radius $R_r$ of the annular recess 28 is obtained by subtracting $D_i - D_t$ and dividing the result by 4.

That is:

$$R_r = \frac{D_i - D_t}{4} \quad (8)$$

Solving for $R_r$ yields:

$R_r$=0.0525 inches.

The throat angle $\theta$ of the throughbore 32 is then found using the formula:

$$\tan\theta = 2\,R_r/L \quad (9)$$

Where:

$\theta$=angle between tangent line 70 and passageway wall 15

$R_r$=radial dimension of recess 28

L=1.66 $D_i$ (Equation 7)

Solving for $\theta$:

$\theta$=11.6°

Depth of Recess 28

As discussed above, the radial dimension $R_r$ of recess 28 is calculated by subtracting the diameter of the throat of insert 30, $D_t$, from the diameter of the inlet passageway 14, $D_i$. It is important to properly locate the recess 28 relative to the innermost end of the insert 30 within the inlet passageway 14, i.e., relative to the throat or inlet end 34 of throughbore 32, to ensure that the portion 68 of water stream 66 rotating within the recess 28 is tangent to the outer portion of the water stream 66. This is controlled by the depth at which the U-shaped, annular recess 28 is formed in the nozzle body 12 relative to the position of the inner end of insert 30.

It has been determined that it is preferable for the rotating portion 68 of the water stream 66 within recess 28 to contact the main body of the water stream 66 at an axial distance $S_e$ from the throat of the insert 30. This axial distance $S_e$ is based on the hydraulic diameter or hydraulic coefficient $H_c$ of the water stream 66 flowing through the insert 30. For water, the hydraulic coefficient $H_c$ is estimated to be about 80% of the diameter $D_o$ of the throughbore 32 at its outlet end 36.

In equation form, this relationship is given as follows:

$$S_e = 0.80\,D_o \quad (10)$$

Where:

$H_c$=hydraulic coefficient (for water, $H_c$=0.8)

Solving for $S_e$ yields:

$S_e$=0.020 inch.

As shown in FIG. 4, a tangent point 73 is thus formed along tangent line 70 which is spaced an axial distance $S_e$ relative to the throat or inlet end 34 of the throughbore 32. Having determined the location of the tangent point 73 where the rotating portion 68 of the water stream 66 within recess 28 contacts the tangent line 70, and knowing the radius $R_r$ of the recess, the depth $D_r$ of the recess 28 relative to the inlet end 34 of throughbore 32 is readily determined by locating the recess 28 tangent to the tangent line 70 at tangent point 73. See FIG. 4. The depth $D_r$ of recess 28 can then be measured from a drawing of the type shown in FIG. 4. Given the calculated values for $R_r$ and $S_e$ determined above, the depth $D_r$ of recess 28 has been measured to be approximately 0.043 inch.

Throughbore 32 Dimensions

It has been found experimentally that the arcuate section 44 of the inner surface 40 of throughbore 32 should extend axially a distance of about three times the diameter $D_o$ of the cylindrical section 46 from the throat or inlet end 34 of throughbore 32. The exact shape of this arcuate section 44 is determined empirically by experimentation, but it can generally be characterized as a smoothly tapering polynomial curve from the angled throat or inlet end 34 to a point located about 3 $D_o$ along the inner surface 40 of throughbore 32. In addition, the axial length of the cylindrical section 46 of throughbore 32 should be at least about three times its diameter or 3 $D_o$.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the scope thereof.

For example, the outlet passageway 20 in nozzle body 12 downstream from the insert 30 is shown in the FIGS. as being cylindrical in shape and extending some distance beyond the outlet end of the throughbore 32 in insert 30. It is contemplated, however, that the nozzle body 12 could extend varying lengths beyond the outlet end of insert 30, and the outlet passageway 20 in the nozzle body 12 could be formed in any variety of configurations to produce a desired spray pattern of flowable material.

In addition, it is contemplated that the materials forming the nozzle body 12 and insert 30 could widely vary depending upon the particular application for the nozzle 10. Highly abrasive material such as sand or other particulate solids may require the use of wear resistant materials such as case hardened steel, tungsten carbide or ceramics derivative for such elements, whereas softer metals or plastics could be employed where the material to be sprayed would produce little wear of the parts and/or the operating parameters such as material flow rate, velocity and pressure are relatively low.

Therefore, it is intended that the invention not be limited to the particular embodiment disclosed as the best mode contemplated for carrying out this invention, but that the invention will include all embodiments falling within the scope of the appended claims.

I claim:

1. A nozzle for discharging flowable material, comprising:

a nozzle body formed with an inlet passageway adapted to connect to a source of flowable material and a coaxial outlet passageway which intersects said inlet passageway, the diameter of said inlet passageway being greater than the diameter of said outlet passageway so that a shoulder is formed in said nozzle body between the wall of said inlet passageway and the wall of said outlet passageway, said inlet passageway being adapted to receive a stream of flowable material for discharge through said smaller diameter, outlet passageway;

a nozzle insert formed with a throughbore having an angled inlet end and a discharge end, said nozzle insert being mounted within said outlet passageway of said nozzle body so that said angled inlet end of said throughbore extends into said inlet passageway of said nozzle body;

a recess formed in said shoulder of said nozzle body and extending from said wall of said inlet passageway to said wall of said outlet passageway, said recess receiving a first portion of said stream of flowable material entering said inlet passageway to form a rotating body of flowable material therein which rotates in the direction of movement of the flowable material through said nozzle body, said recess being formed with a depth dimension so that said rotating body of flowable material therein tangentially contacts a second portion of said stream of flowable material to smoothly guide and accelerate said second portion of said stream of flowable material from said inlet passageway into said angled inlet end of said throughbore of said nozzle insert for discharge through said outlet passageway in said nozzle body.

2. The nozzle of claim 1 in which said recess is annular in shape.

3. The nozzle of claim I in which said nozzle insert is tubular in shape having a wall formed by said throughbore, the thickness of said wall being about equal to half the diameter of said throughbore.

4. The nozzle of claim 1 in which said wall of said nozzle insert at said inlet end of said throughbore is formed at an acute angle relative to the longitudinal axis of said inlet passageway.

5. The nozzle of claim 1 in which said throughbore forms an inner wall in said nozzle insert, said inner wall having a first portion which is arcuate in shape extending axially from said inlet end of said throughbore toward said discharge end, said inner wall having a second portion which is cylindrical in shape extending axially from said first portion to said discharge end of said throughbore.

6. The nozzle of claim 5 in which the axial length of said first portion of said inner wall of said nozzle insert formed by said throughbore is about three times the diameter of said cylindrical-shaped second portion of said inner wall.

7. The nozzle of claim 5 in which the axial length of said second portion of said inner wall of said nozzle insert is at least about three times its diameter.

8. The nozzle of claim 1 in which said recess is annular in shape and concentric relative to said outlet passageway.

9. The nozzle of claim in which said recess has a U-shaped cross section.

10. A nozzle for discharging flowable material, comprising:

a nozzle body formed with an inlet passageway adapted to connect to a source of flowable material and a coaxial outlet passageway which intersects said inlet passageway, the diameter of said inlet passageway being greater than the diameter of said outlet passageway so that a shoulder is formed in said nozzle body between the wall of said inlet passageway and the wall of said outlet passageway, said inlet passageway being adapted to receive a stream of flowable material for discharge through said smaller diameter, outlet passageway;

an annular recess formed in said shoulder of said nozzle body concentric relative to said outlet passageway;

said recess being radially spaced from said outlet passageway to form a wall section extending between said recess and said outlet passageway, said wall section having an angled inlet end extending at least partially into said inlet passageway of said nozzle body, said recess receiving a first portion of said stream of flowable material entering said inlet passageway to form a rotating body of flowable material therein which rotates in the direction of movement of the flowable material through said nozzle body, said recess being formed with a depth dimension so that said rotating body of flowable material therein tangentially contacts a second portion of said stream of flowable material to smoothly guide and accelerate said second portion of said stream of flowable material from said inlet passageway, past said angled inlet end of said wall section formed by said recess and then into said outlet passageway with a minimum of turbulence.

11. The nozzle of claim 10 in which the thickness of said wall section is about equal to half the diameter of said outlet passageway.

12. The nozzle of claim 10 in which said inner end of said wall section is formed at an acute angle relative to the longitudinal axis of said inlet passageway.

13. The nozzle of claim 10 in which said wall section has an inner surface and said outlet passageway has a discharge end, said inner surface of said wall section being formed with a first portion which is arcuate in shape extending axially from said inner end of said wall section toward said discharge end of said outlet passageway, said outlet passageway being cylindrical in shape between said first portion of said wall section to said discharge end of said outlet passageway.

14. The nozzle of claim 13 in which the axial length of said first portion of said inner surface of said wall section is about three times the diameter of said outlet passageway along said second portion of said inner surface.

15. The nozzle of claim 13 in which the axial length of said cylindrical-shaped portion of said outlet passageway is at least about three times its diameter.

16. The method of accelerating flowable material through a nozzle, comprising:

transmitting a stream of flowable material into the inlet passageway of a nozzle body;

directing a first portion of said stream into a recess formed in a shoulder of said nozzle body located at the intersection of said inlet passageway and a coaxial outlet passageway having a smaller diameter than said inlet passageway, said first portion of said stream within said recess being rotated in the direction of movement of said stream through said nozzle body;

impacting the outermost surface of a second portion of said stream with said rotating, first portion of said stream within said recess to guide and accelerate said stream into said outlet passageway of said nozzle body.

17. The method of accelerating flowable material through a nozzle, comprising:

transmitting a stream of flowable material into the inlet passageway of a nozzle body, said nozzle body being formed with a recess at a shoulder formed by the intersection of said inlet passageway with a coaxial outlet passageway having a smaller diameter than said inlet passageway;

rotating a first portion of said stream within said recess in the direction of movement of said stream through said nozzle body;

impacting the outermost surface of a second portion of said stream at a point tangent thereto with said first portion of said stream rotating within said recess;

guiding and accelerating said second portion of said stream into the angled inlet end of a throughbore formed in a tubular wall section extending outwardly from said outlet passageway at least partially into said inlet passageway.

* * * * *

UNITED STATES PATENT AND TRADEMARK OFFICE

CERTIFICATE OF CORRECTION

PATENT NO. : 4,830,280

DATED : May 16, 1989

INVENTOR(S) : Gerald K. Yankoff

It is certified that error appears in the above-identified patent and that said Letters Patent is hereby corrected as shown below:

In column 4, line 42, "surface 4" should be --surface 40--.

In column 6, line 64, "sam" should be --same--.

In column 8, line 65, "$S_e$ = 0.020" should be --$S_e$ = 0.041--.

In column 10, line 37, "claim I" should be --claim 1--.

Signed and Sealed this

Seventeenth Day of April, 1990

*Attest:*

HARRY F. MANBECK, JR.

*Attesting Officer*

*Commissioner of Patents and Trademarks*